United States Patent [19]

Freeman

[11] 4,204,694

[45] May 27, 1980

[54] SAIL APPARATUS FOR A LAND VEHICLE

[76] Inventor: John L. Freeman, 1 West 67th St., New York, N.Y. 10023

[21] Appl. No.: 918,082

[22] Filed: Jun. 22, 1978

[51] Int. Cl.[2] ..... A63C 11/00

[52] U.S. Cl. ..... 280/810

[58] Field of Search ..... 280/11.37 S, 11.37 E, 280/11.37 R, 213, 12 KL, 12 L; 114/39, 102, 113, 114

[56] References Cited

U.S. PATENT DOCUMENTS

| | | | |
|---|---|---|---|
| 1,082,831 | 12/1913 | Stanbrough | 280/213 |
| 3,103,196 | 9/1963 | Christman | 114/39 |
| 3,336,890 | 8/1967 | Laurent | 114/39 |
| 3,455,261 | 7/1969 | Perrin | 280/11.37 S |
| 3,487,800 | 1/1970 | Schweitzer et al. | 280/11.37 E |
| 3,582,067 | 6/1971 | Rucks | 280/11.37 E |
| 3,768,823 | 10/1973 | Goldberg | 280/11.37 S |
| 3,793,973 | 2/1974 | Patterson | 114/39 |
| 3,830,512 | 8/1974 | Spiegel | 280/11.37 S |
| 3,924,870 | 12/1975 | Spivack | 280/11.37 S |
| 3,982,766 | 9/1976 | Budge | 280/11.37 S |
| 4,112,865 | 9/1978 | Carn | 114/39 |

FOREIGN PATENT DOCUMENTS

| | | | |
|---|---|---|---|
| 13780 | 2/1903 | Austria | 280/11.37 S |
| 2604132 | 8/1977 | Fed. Rep. of Germany | 280/11.37 S |
| 2649397 | 5/1978 | Fed. Rep. of Germany | 280/11.37 S |

*Primary Examiner*—David M. Mitchell

*Attorney, Agent, or Firm*—Spellman, Joel & Pelton

[57] ABSTRACT

Two sail structures are disclosed for use in propelling a movable body, such as a ski, skate, iceboat or the like, over a solid surface. One sail structure uses the lateen configuration and includes a triangular shaped sail with an upper spar and lower boom for holding the sail in an open, triangular form; as well as a mast, connectable to the spar and boom, for supporting the sail in a lateen configuration. The other sail structure includes a vertical mast and a horizontal boom connected in a "cross." A first right-triangular sail is connected at its three corners to the forward end of the boom, the top of the mast and the coupling point of the mast and boom. A second right-triangular sail has its edges connected along the mast and boom, between the coupling point and the top of the mast and between the coupling point and the rearwad end of the boom. With both sail structures, the bottom of the mast is detachably coupled to the transport body in such a manner that the mast may be articulated with respect to the body in any direction.

24 Claims, 12 Drawing Figures

FIG. 1
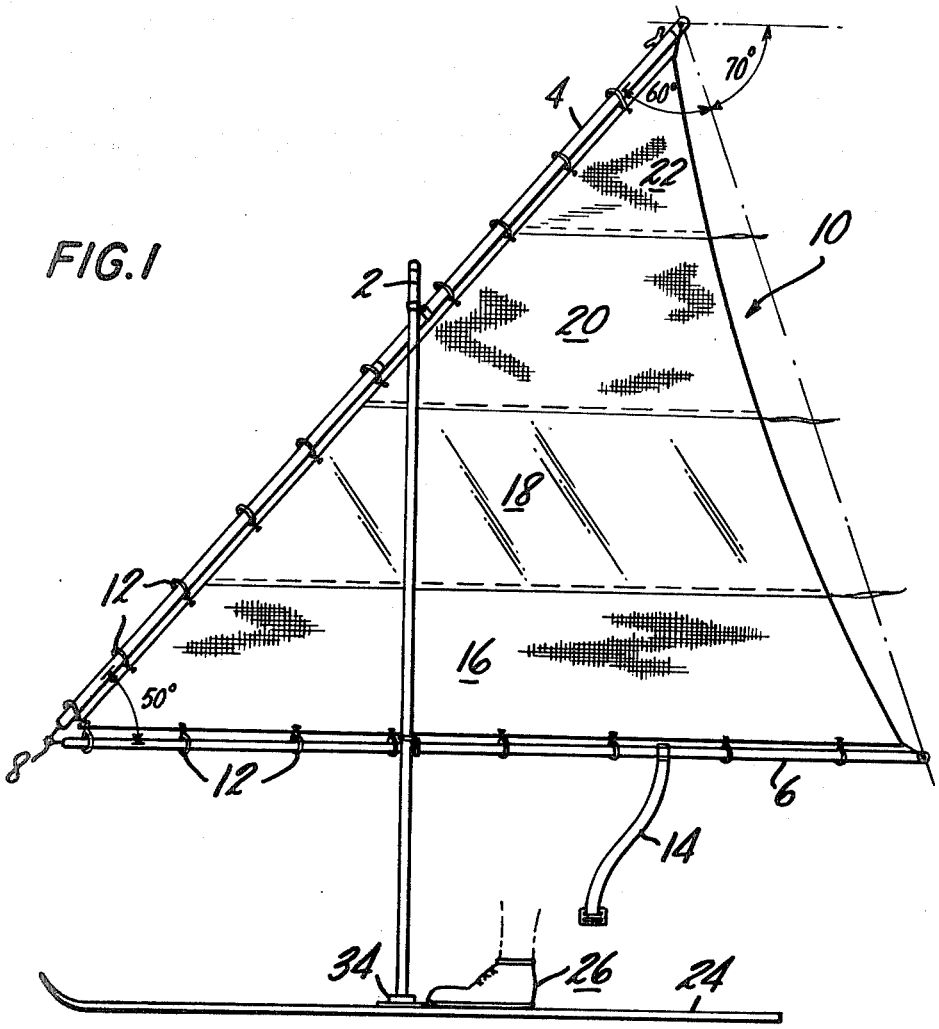
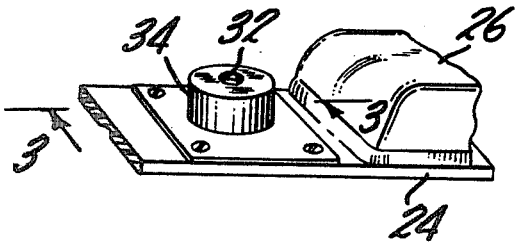
FIG. 2
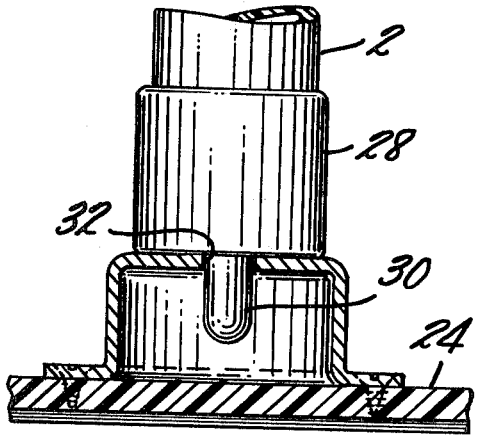
FIG. 3

SAIL APPARATUS FOR A LAND VEHICLE

BACKGROUND OF THE INVENTION

The present invention relates to sail apparatus for propelling a body over a solid surface. In particular, the invention relates to conventional sail structures which may be used to propel a ski, skate, iceboat or the like over the ground.

Numerous sail structures are known which are intended to propel a person over solid ground (including ice and snow) using some kind of body member as a means of transport. The U.S. Pat. No. 3,982,766 to Budge discloses a conventional triangular sail intended for use with a skateboard. In this sail structure the horizontal boom is relatively low and extends outward only to one side (i.e., rearward) of the mast. Consequently, the boom cannot be conveniently held and manipulated and it requires considerable force to maintain its attitude with respect to the wind.

The U.S. Pat. No. 3,487,800 to Schweitzer et al. discloses a similar sail configuration for iceboats and other land vehicles. Although the boom in this case has been raised to a more convenient height, it still requires the application of a constant and substantial force to maintain its attitude with respect to the wind. In addition, as in the case with the skateboard sail in the U.S. Pat. No. 3,982,766, the sail is completely opaque and therefore blocks the view of the user.

The U.S. Pat. No. 3,455,261 and 3,830,512 disclose sail structures which are held directly by the user. Because these structures do not include a mast, the user must expend considerable strength in maintaining the sail in position. To some extent, the user himself thus forms the "mast" for the sail.

SUMMARY OF THE INVENTION

It is an object of the present invention to provide sail structures for land vehicles which are convenient to use and which require very little force to maintain their position and attitude with respect to the wind.

This object, as well as further objects which will become apparent in the discussion that follows are achieved according to the present invention, by providing two specific sail structures in which a portion of the effective sail surface lies forward of a substantially vertical mast. To accomplish this one sail structure uses the lateen configuration and includes a triangular shaped sail with an upper spar and lower boom for holding the sail in an open, triangular form; as well as a mast, connectable to the spar and boom, for supporting the sail in a lateen configuration. The other sail structure includes a vertical mast and a horizontal boom connected in a "cross." A first right-triangular sail is connected at its three corners to the foward end of the boom, the top of the mast and the coupling point of the mast and boom. A second right-triangular sail has its edges connected along the mast and boom, between the coupling point and the top of the mast and between the coupling point and the rearward end of the boom. With both sail structures, the bottom of the mast is detachably coupled to the transport body in such a manner that the mast may be articulated with respect to the body in any direction.

BRIEF DESCRIPTION OF THE DRAWINGS

FIG. 1 is a side elevational view of a lateen sail configuration according to a first preferred embodiment of the present invention. This sail structure is arranged on a ski.

FIG. 2 is a perspective view showing a detail of the ski shown in FIG. 1.

FIG. 3 is a vertical cross-sectional view taken along the line 3—3 in FIG. 2.

DESCRIPTION OF THE PREFERRED EMBODIMENT

Figure 4:
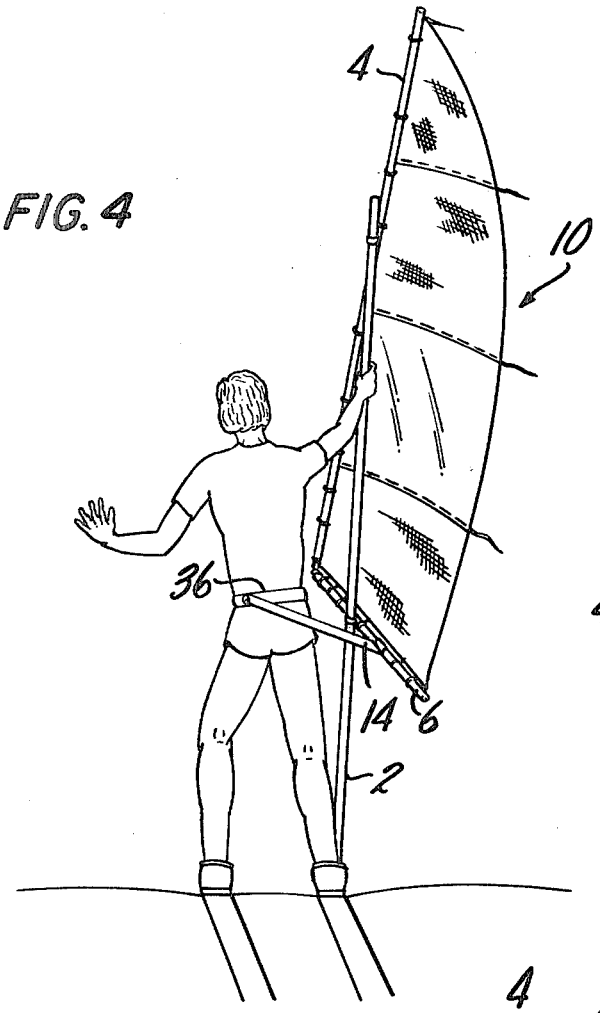
FIG. 4 is a perspective view showing the sail structure of FIG. 1 in use.

The preferred embodiments of the present invention will now be described with reference to FIGS. 1–12 of the drawings. Identical elements in the various figures are designated with the same reference numerals.

FIG. 1 shows a sail structure in a lateen configuration mounted on one of a pair of skis. The sail structure comprises a mast 2 which supports a spar 4 and boom 6. The spar and boom are connected together at their forward ends 8 and hold a triangular sail 10. The sail may be lashed to the spar and boom by loops 12, as shown, or may be held in position by some other means known in the art.

The spar 4 is connected to the mast in such a way that its weight is supported but it may swivel and tilt in any direction. The boom 6 is supported in such a way as to prevent horizontal movement with respect to the mast. It also is permitted to swivel and tilt and may slide vertically up or down on the mast so that, by its own weight, the sail 10 is held taut.

As indicated in FIG. 1, the spar 4 and boom 6 form an angle of approximately 50° with respect to each other. The boom is arranged substantially horizontally so that the spar extends diagonally upward at this 50° angle. The spar and boom are of such a length that the sail forms an angle of approximately 60° at its upper corner.

As may be seen in FIG. 1, a portion of the sail surface lies forward of the mast 2 so that the force of the wind is used, to some extent, to maintain the sail in the proper attitude. Since most of the sail's surface lies behind the mast, a tension force must always be applied to the boom behind the mast to maintain this attitude. This tension may be applied by a flexible strap 14 attached to the user's waist.

In this specific embodiment, the boom may extend 4½ feet forward of the mast and 7 feet to the rear, so that the total length of the boom is 11½ feet. The spar extends 7 feet forward of the mast and 6 feet to the rear, for a total length of 13 feet. The boom is arranged at approximately waist height, or about 3½ feet above the bottom of the mast.

The sail is constructed (i.e., sewed) in horizontal sections 16, 18, 20 and 22, each about 2 feet wide. The second lowest section, which is about head high for the user of the sail, is transparent to permit the user to see where he is going. The other sections, 16, 20 and 22 are preferably of cloth, which may be thinner and lighter than transparent material.

As noted above, the sail structure shown in FIG. 1 and, in particular, the mast 2 rests on a ski 24. Specifically, the mast 2 is detachably coupled to the ski 24 at a point directly forward of the user's boot 26 in such a manner that it may be articulated with respect to the ski in any direction.

A preferred form of the coupling device is shown in FIGS. 2 and 3. As indicated there, a sleeve 28 provided with a central pin 30 is attached to the end of the mast 2. This pin 30 is inserted in an opening 32 in a receptacle 34 attached to the ski 24. The diameter of the opening 32 is somewhat larger than that of the pin 30 so that the mast 2 may be tilted in any direction up to an angle of approximately 30° with respect to the vertical. The mast may also be rotated and may easily be disconnected or removed from the ski.

FIG. 4 illustrates how the sail structure according to the invention is used by a skier. The skier places the pin 30 of the mast 2 in a receptacle 34 on one of his skis. He also attaches the flexible strap 14, which is connected to the boom at a point rearward of the mast, to his waist by means of a suitable belt 36. Preferably, the strap 14 is adjustable in length so that the orientation of the boom may be varied in accordance with the wind direction. The user then grasps the mast 2 at a point approximately head high and leans in the opposite direction from the sail structure to balance the force of the wind.

Figure 6:
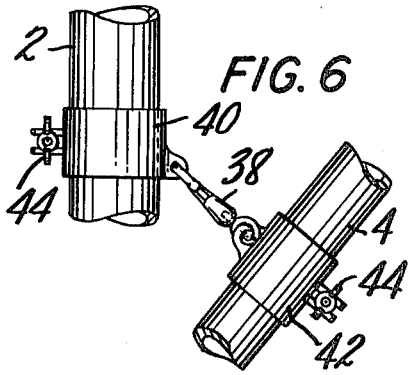
FIG. 6 is a side elevational view of the mast-spar connection in the sail structure of FIG. 1.

The sail structure according to the invention may be mounted on either ski. Preferably, both of the user's skis are provided with a receptacle 34. While FIG. 4 shows the sail structure mounted on the user's right ski, it will be understood that it can also be mounted on the left ski with the spar 4 and boom 6 arranged on the left-hand side of the mast 2. In order to permit the spar and boom to be quickly and easily moved from one side of the mast to the other, the connections with the mast are made with flexible couplings. FIG. 6 shows a preferred embodiment of a coupling between the mast 2 and spar 4 which employs a snap hook 38 connecting the eyes of two rings 40 and 42, surrounding the mast 2 and spar 4, respectively. The rings may be adjusted in their position longitudinally along the mast and/or spar by loosening wing nuts 44 which control the tightness or grip with which the rings surround the mast and spar.

Figure 7:
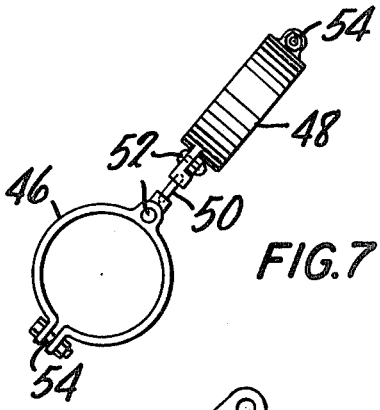
FIG. 7 is a side elevational view of a lateen ring.

Whereas the means for coupling the spar to the mast may remain connected when the sail is moved from one side of the mast to the other, the coupling device between the boom and mast must be disconnected. Such a coupling device, which provides the necessary degrees of freedom is a so-called "lateen ring," which is illustrated in FIG. 7. The lateen ring comprises two rings 46 and 48 connected together by a swivel joint 50.

The rings 46 and 48 are each pivoted adjacent the swivel joint 50 on bolts or rivets 52. Thus, each ring may be disconnected from the mast or boom, and may be connected again and clamped tight by means of bolts 54.

Figure 5:
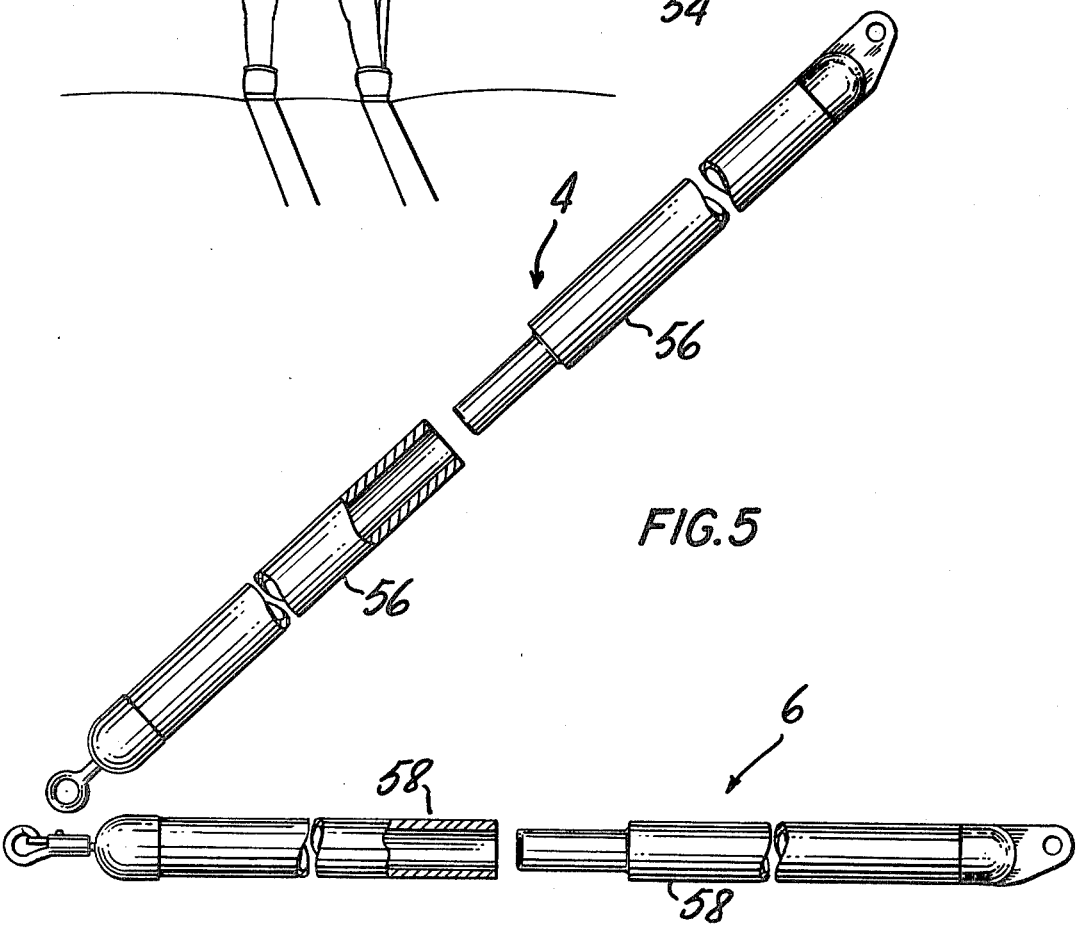
FIG. 5 is a side elevational view, partially in cross-section, showing how the spar and boom in the sail structure of FIG. 1 are assembled.

FIG. 5 shows how the spar 4 and boom 6 may be constructed of several (preferably two) equal sections 56 and 58, respectively. When assembled together with the sail 10, the spar and boom cannot pull apart. Similarly, the mast is preferably formed of at least two sections of equal length which may be coupled together end to end. This construction of mast, spar and boom permits the sail structure to be disassembled into a conveniently small package.

Figure 8:
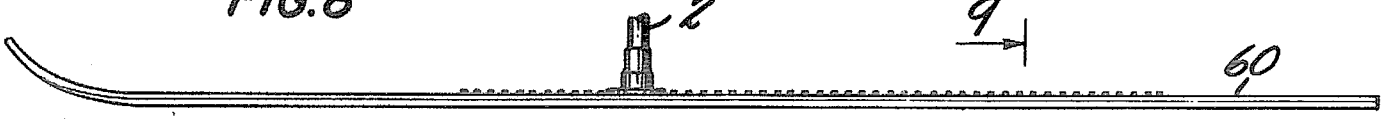
FIG. 8 is a side elevational view of a "uniski" to which the sail structure according to the present invention may be attached.
Figure 9:
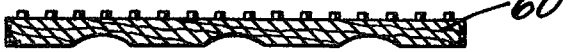
FIG. 9 is a vertical cross-sectional view of the uniski of FIG. 8 taken along the line 9—9.
Figure 10:
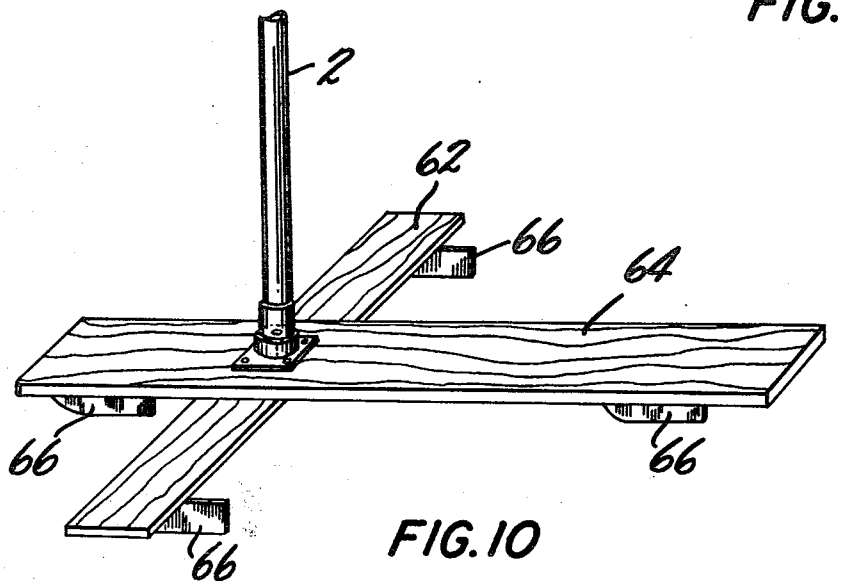
FIG. 10 is a perspective view of an iceboat to which the mast of a sail structure according to the invention may be attached.
Figure 11:
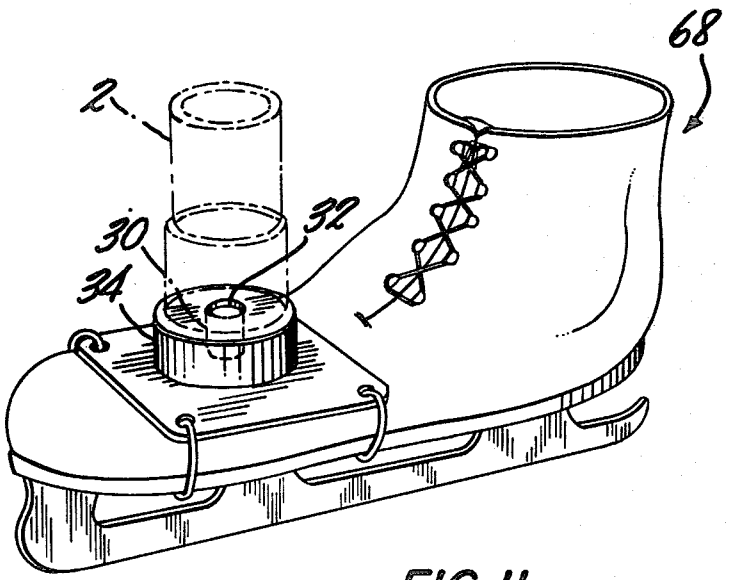
FIG. 11 is a perspective view of an ice skate to which the mast of a sail structure according to the invention may be attached.

The sail structure according to the invention is not limited in use to a pair of skis. FIGS. 8 and 9 illustrate a "uniski" 60 with the mast 2 of the sail structure located slightly forward of the mid-point or center of gravity. FIG. 10 illustrates an iceboat formed of two cross members 62 and 64 and a set of skate blades 66 attached at opposite ends to the underside of each cross member. In this case, the mast 2 is coupled to the iceboat at the apex, or cross point of the two cross members. FIG. 11 illustrates a conventional ice skate 68 having the coupling device or receptacle 34 for the mast lashed to the toe.

Figure 12:
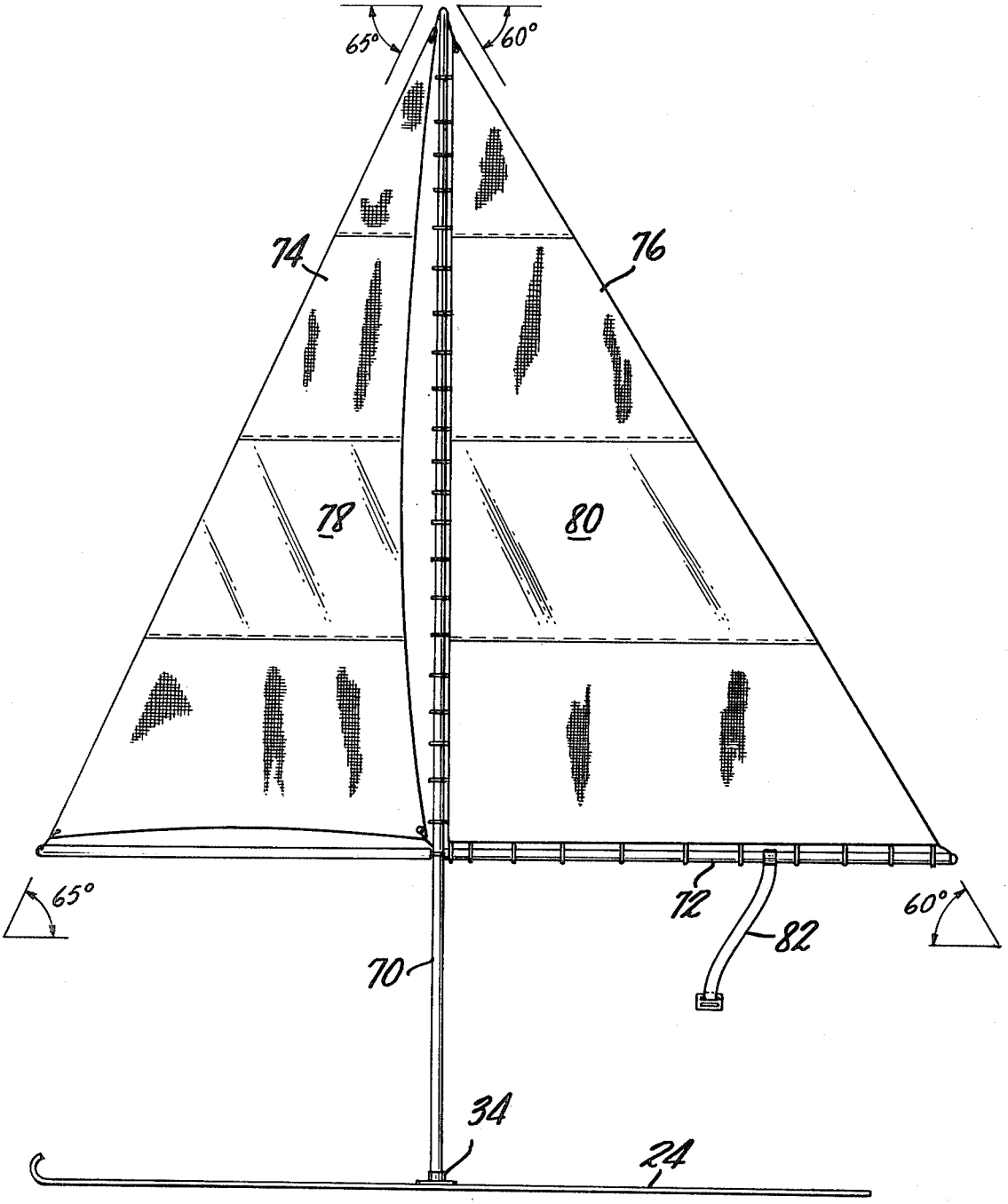
FIG. 12 is a side elevational view of a sail structure according to the second preferred embodiment of the present invention.

FIG. 12 illustrates a second preferred embodiment of a sail structure according to the present invention. This structure, which is also shown as being mounted on a ski 24 at a recpetacle 34, comprises a mast 70, a boom 72 and two triangular sails 74 and 76. The boom is pivoted on the mast at approximately waist height by a detachable coupling device such as the lateen ring shown in FIG. 7. The two sails 74 and 76 are attached to this "cross" structure in the following manner:

The forward sail 74, which is of right-triangular shape, is connected at its three corners to the forward end of the boom, the top of the end of the mast and the coupling point of the mast and boom. The rearward sail 76, which is also of right-triangular shape, is connected along its forward edge to the mast between the coupling point and the top end thereof, and is connected along its bottom edge to the boom, between the coupling point and the rearward end thereof.

In the embodiment shown in FIG. 12 the three corners of the forward sail 74 form angles of 25°, 90° and 65°, respectively; and the three corners of the rearward sail 76 form angles of 30°, 60° and 90°, respectively. As in the case of the lateen sail 10 shown in FIG. 1, the sails 74 and 76 are provided with transparent sections 78 and 80, respectively, at approximately head height to permit the user to see through them.

The sail structure illustrated in FIG. 12 may be used in the same manner as the sail structure shown in FIGS. 1 and 4. In particular, a strap 82 is attached to the boom 72 and to the waist of the user to maintain the proper attitude of the sails with respect to the wind. It is also usable with any of the transport bodies contemplated for the sail structure of FIGS. 1 and 4. An advantage of this sail structure over the lateen configuration is that it is not necessary to move the boom to the opposite side of the mast when tacking into the wind.

While there have been described what are believed to be the preferred embodiments of the invention, those skilled in the art will recognize that various changes and modifications may be made thereto without departing from the spirit of the invention, and it is intended to claim all such embodiments as fall within the true scope of the invention.

I claim:

1. Lateen sail apparatus for use in propelling a body member adapted to transport a user in a standing or crouching position over a solid surface, said apparatus comprising:

(a) a triangular-shaped sail;

(b) means including an upper spar and a lower boom for holding said sail in an open, triangular form;

(c) a mast, connectable to said spar and said boom at positions substantially midway between the respective ends thereof, for supporting said holding means in a lateen configuration such that the sail area forward of the mast is a significant proportion of, but does not exceed the said area rearward of the mast; and (d) means for detachably coupling said mast to the body member in such a manner that said mast may be articulated with respect to the body member throughout all vertical planes about said coupling means.

2. The sail apparatus recited in claim 1, wherein the body member is a ski having means for attaching a boot thereto, and wherein said coupling means is attached to said ski at a point directly forward of said boot attaching means.

3. The sail apparatus recited in claim 1, wherein the body member is an ice boat comprising two cross members and a set of ice skating blades attached to the under-side of said cross members, and wherein said coupling means is attached to said cross members at the intersection thereof.

4. The sail apparatus recited in claim 1, wherein the body member is an ice skate comprising a boot having a toe portion and an ice skating blade, and wherein said coupling means is attached to said ice skate on said toe portion.

5. The sail apparatus recited in claim 1, wherein said boom is arranged in a substantially horizontal plane.

6. The sail apparatus recited in claim 1, wherein said boom is supported by said mast at substantially waist height.

7. The sail apparatus recited in claim 1, wherein said sail is made, at least in part, of transparent material.

8. The sail apparatus recited in claim 7, wherein said sail comprises a window, made of transparent material, arranged substantially head high when the apparatus is in use.

9. The sail apparatus recited in claim 1, wherein said spar and said boom are each formed of at least two elongate members of substantially equal length which may be coupled together end to end.

10. The said apparatus recited in claim 1, wherein said mast is formed of at least two elongate members of substantially equal length which may be coupled together end to end.

11. The sail apparatus recited in claim 1, wherein said spar and said boom are joined together at their forward end, forming an angle of approximately 50°.

12. The sail apparatus recited in claim 1, further comprising a flexible strip, attached to said boom at a point rearward of said mast, for releasably attaching said boom to the waist of a user when the apparatus is in use.

13. The sail apparatus recited in claim 1, further comprising flexible attachment means between said mast and said spar for supporting said spar on said mast and permitting said spar to be arranged adjacent to said mast on either side thereof when said mast is in an upright, operative position.

14. The sail apparatus recited in claim 1, further comprising a lateen ring for attaching said boom to said mast, whereby said boom may be coupled to said mast on either side thereof when said mast is in an upright, operative position.

15. Sail apparatus for use in propelling a body member adapted to transport a user in a standing or crouching position over a solid surface, said apparatus comprising:

(a) a mast having a top and bottom end, adapted to be arranged substantially vertically when in use;

(b) a continuous boom having a forward and rearward end and coupled to said mast at a point between said ends, said boom being adapted to be arranged substantially horizontally and to remain rigid along its entire length when in use;

(c) a first right-triangular shaped sail connected, respectively, at its three corners to the forward end of said boom, the top end of said mast and the coupling point of said mast and boom;

(d) a second right-triangular shaped sail connected respectively, along its two perpendicular sides to said mast, between said coupling point and said top end, and to said boom, between said coupling point and said rearward end;

(e) means for detachably coupling the bottom end of said mast to the body member in such a manner that said mast may be articulated with respect to the body member throughout all vertical planes about said coupling means.

16. The sail apparatus recited in claim 15, wherein the body member is a ski having means for attaching a boot thereto, and wherein said coupling means is attached to said ski at a point directly forward of said boot attaching means.

17. The sail apparatus recited in claim 15, wherein the body member is an ice boat comprising two cross members and a set of ice skating blades attached to the under-side of said cross members, and wherein said coupling means is attached to said cross members at the intersection thereof.

18. The sail apparatus recited in claim 15, wherein the body member is an ice skate comprising a boot having a toe portion and an ice skating blade, and wherein said coupling means is attached to said ice skate on said toe portion.

19. The sail apparatus recited in claim 15, wherein said boom is supported by said mast at substantially waist height.

20. The sail apparatus recited in claim 15, wherein said first and second sails are made, at least in part, of transparent material.

21. The sail apparatus recited in claim 20, wherein said first and second sails comprise a window, made of transparent material, arranged substantially head high when the apparatus is in use.

22. The sail apparatus recited in claim 15, wherein said boom is formed of at least two elongate members of substantially equal length which may be coupled end to end.

23. The sail apparatus recited in claim 15, wherein said mast is formed of at least two elongate members of substantially equal length which may be coupled together end to end.

24. The sail apparatus recited in claim 15, further comprising a flexible strip, attached to said boom at a point rearward of said mast, for releasably attaching said boom to the waist of a user when the apparatus is in use.

* * * * *